US008733475B2

(12) United States Patent
Vo et al.

(10) Patent No.: US 8,733,475 B2
(45) Date of Patent: May 27, 2014

(54) DRILL BIT WITH ENHANCED HYDRAULICS AND EROSION-SHIELD CUTTING TEETH

(75) Inventors: Thang Vo, Houston, TX (US); Tom Scott Roberts, Magnolia, TX (US); Craig Ivie, Willis, TX (US); Douglas Caraway, Conroe, TX (US)

(73) Assignee: National Oilwell DHT, L.P., Conroe, TX (US)

( * ) Notice: Subject to any disclaimer, the term of this patent is extended or adjusted under 35 U.S.C. 154(b) by 576 days.

(21) Appl. No.: 13/016,332

(22) Filed: Jan. 28, 2011

(65) Prior Publication Data

US 2012/0193149 A1 Aug. 2, 2012

(51) Int. Cl.
*E21B 10/08* (2006.01)

(52) U.S. Cl.
USPC ..... 175/340; 175/331; 175/430

(58) Field of Classification Search
USPC ..... 175/331, 339–341, 429, 430
See application file for complete search history.

(56) References Cited

U.S. PATENT DOCUMENTS

| | | | | |
|---|---|---|---|---|
| 4,368,788 | A | 1/1983 | Drake | |
| 4,372,404 | A | 2/1983 | Drake | |
| 4,393,948 | A | 7/1983 | Fernandez | |
| 4,398,952 | A | 8/1983 | Drake | |
| 4,554,130 | A | 11/1985 | Ecer | |
| 4,562,892 | A | 1/1986 | Ecer | |
| 4,592,252 | A | 6/1986 | Ecer | |
| 4,597,456 | A | 7/1986 | Ecer | |
| 4,630,692 | A | 12/1986 | Ecer | |
| 4,741,406 | A | 5/1988 | Deane et al. | |
| 4,853,178 | A | 8/1989 | Oslin | |
| 4,933,140 | A | 6/1990 | Oslin | |
| 4,949,598 | A | 8/1990 | Griffin | |
| 4,989,680 | A | 2/1991 | Deane et al. | |
| 5,027,913 | A | 7/1991 | Nguyen | |
| 5,029,656 | A | 7/1991 | Ivie et al. | |
| 5,032,352 | A | 7/1991 | Meeks et al. | |
| 5,197,555 | A | 3/1993 | Estes | |
| 5,201,376 | A * | 4/1993 | Williams | 175/374 |
| 5,224,560 | A | 7/1993 | Fernandez | |
| 5,839,526 | A | 11/1998 | Cisneros et al. | |
| 5,967,248 | A | 10/1999 | Drake et al. | |
| 6,045,750 | A | 4/2000 | Drake et al. | |
| 6,060,016 | A | 5/2000 | Vuyk, Jr. et al. | |
| 6,095,262 | A | 8/2000 | Chen | |
| 6,135,218 | A | 10/2000 | Deane et al. | |
| 6,338,621 | B1 | 1/2002 | Vuyk, Jr. et al. | |
| 6,347,676 | B1 | 2/2002 | Vuyk, Jr. | |
| 6,401,839 | B1 | 6/2002 | Chen | |
| 6,412,577 | B1 | 7/2002 | Chen | |
| 6,827,161 | B2 | 12/2004 | Singh et al. | |
| 7,334,652 | B2 | 2/2008 | Chen et al. | |

OTHER PUBLICATIONS

Canadian Office Action dated May 30, 2013; Canadian Application No. 2,756,956 (3 p.).

* cited by examiner

*Primary Examiner* — Kenneth L Thompson
*Assistant Examiner* — Taras P Bemko
(74) *Attorney, Agent, or Firm* — Conley Rose, P.C.

(57) ABSTRACT

Disclosed is a rolling cone drill bit with inner row cutting teeth having portions shielded with an erosion-resistant material that differs in material properties from the tooth's core portion that is more impact resistant. The tooth includes shielding on at least a portion of the upstream end and along portions of the flanking surfaces. It includes shield-free portions on the flanks between the root and the tooth crest. Most of the tooth's perimeter is made of the core material and is free of shielding. Gage row teeth may be angled and form a channel to direct drilling fluid from the gage region of the borehole to locations where the inner row teeth are generating most cuttings. Nozzles are provided with non-uniform orientations.

26 Claims, 7 Drawing Sheets

DRILL BIT WITH ENHANCED HYDRAULICS AND EROSION-SHIELD CUTTING TEETH

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of Technology

The disclosure relates generally to earth-boring bits used to drill a borehole for the recovery of oil, gas or minerals. More particularly, this disclosure relates to rolling cone drill bits having enhanced hydraulics and erosion-resistant cutting teeth.

2. Background Information

A conventional earth-boring drill bit is mounted on the lower end of a drill string. The bit is turned by rotating the drill string at the surface, by actuation of downhole motors or turbines, or by both methods. With weight applied to the drill string, the rotating drill bit engages the earthen formation and drills a borehole toward a target zone. The borehole created will have a diameter generally equal to the diameter or "gage" of the drill bit.

One type of conventional bit includes one or more rolling cone cutters. As the bit is rotated, the cutters roll and slide upon the bottom of the borehole, breaking up the formation material. Typically, the cutting action of the cone cutters is enhanced by providing cutting elements (e.g., teeth) on the rolling cones. The borehole is formed as the action of the rolling cones and their cutting elements gouge, crush and shear formation material in the bit's path.

Rolling cone bits are typically characterized by the type of cutting elements employed on the rolling cones. A first type employs inserts formed of a very hard material, such as tungsten carbide, that are press fit into undersized holes formed in the cone surface. Such bits are typically referred to as "TCI" bits or "insert" bits. A second general bit type includes teeth that are milled, cast, or otherwise integrally formed from the material of the rolling cone, such bits being generally known as "steel tooth bits."

While drilling, it is conventional practice to pump drilling fluid (also referred to as "drilling mud") down the length of the tubular drill string where it is jetted from the face of the drill bit through nozzles. The hydraulic energy thus supplied flushes the drilled cuttings away from the cutters and the borehole bottom, and carries them to the surface through the annulus that exists between the tubular drill string and the borehole wall.

The cost of drilling a borehole is very high, and is proportional to the time it takes to drill to the targeted depth and location. In turn, the time required to drill the well is greatly affected by the number of times the drill bit must be changed before reaching the targeted formation, as is necessary, for example, when the bit becomes worn or encounters formations for which it is not well suited to drill. The length of time before a drill bit must be changed depends upon its rate of penetration ("ROP") as well as its durability. Whenever a bit must be changed, the entire drill string, which may be miles long and is made up of discrete sections of drill pipe that have been threaded together, must be retrieved from the borehole, section by section. Once the drill string has been retrieved and the new bit installed, the bit must be lowered back to the bottom of the borehole. This is accomplished by reconstructing the drill string, section by section. This process, known as a "trip" of the drill string, requires considerable time, effort and expense. Accordingly, it is desirable to employ drill bits that drill faster and longer, and that drill with an acceptable ROP over a wide range of formation types.

A drill bit's ROP and durability may be substantially affected by the design, placement and orientation of the nozzles in the bit face. For example, when drilling softer formations and plastic formations, cuttings tend to adhere to the cone cutters and between the cones' cutting elements, a phenomenon commonly referred to as "bit balling." When bit balling occurs, the penetration of the individual cutting elements into the formation is restricted. With less penetration, the amount of formation material gouged or otherwise removed by the cutting elements is reduced, leading to a reduction in the bit's ROP. Also, formation packed against the cone cutters may close or greatly restrict the flow channels needed for the drilling fluid to carry away cuttings. This may promote premature bit wear. In either instance, having sufficient fluid flow can help to clean the cutting teeth, allowing them to penetrate to a greater depth, and to maintain the desired ROP.

A conventional nozzle arrangement includes the placement of a nozzle between each of the cone cutters and near to the cones' outermost row of cutter elements. Typically, the bit's hydraulics are designed such that each of these nozzles has the same orientation as the others that are similarly positioned. In other conventional designs, additional nozzles are positioned elsewhere in the bit body to direct a high velocity stream at other predetermined locations. However, conventional arrangements may not direct the hydraulic flow to the locations where cleaning is most needed and, for example, may not provide sufficient cleaning along the inner rows of the cones' cutting elements.

Further, drilling fluid, as it picks up and mixes with the drilled cuttings, becomes highly abrasive. The impact of the cutting-laden fluid directly on cutting teeth may severely erode the teeth. As with poor bit hydraulics, tooth erosion and/or loss of teeth may lead to a reduction in ROP and bit life, and necessitate a costly and premature trip of the drill string.

Accordingly, there is a need for bits having improved bit hydraulics that provide cleaning of cutting elements along the outer and inner rows of the cones in order to minimize bit balling and maintain acceptable ROP, without causing detrimental erosion of the cutting teeth.

SUMMARY OF THE DISCLOSURE

In one embodiment, a drill bit is disclosed having a circumferential outer gage row of cutting teeth on a cone cutter, and a circumferential inner row of cutting teeth spaced apart from the gage row. The cutting teeth of the inner row include an erosion shield on at least a portion of the upstream-facing end of the cutting tooth and on at least a portion of the crest of the cutting tooth, and include shield-free portions on the flanking surfaces of the tooth at locations disposed between the root and its crest. In certain embodiments, the outer row of gage cutting teeth provides a channel and conveys drilling fluid along a predetermined fluid path toward an inner row cutting tooth. In some embodiments, the cutting teeth in the outer gage row are skewed such that their crests are not aligned with the cone axis of rotation. The crests may be angled between approximately 5° and approximately 30° relative to the cone axis.

In other embodiments described herein, a rolling cone drill bit includes cutting teeth having a root portion adjacent to the generally conical surface of the cone cutter, a pair of flanking surfaces extending from the root portion and intersecting in an elongate crest, and a erosion-shielding cap disposed along at least a portion of the crest and along at least a portion of the upstream end of the tooth, with the flanking surfaces including shield-free portions adjacent to the root. In certain embodiments, the shielding cap on the flanking surface extends from the crest towards said root portion for a distance greater than or equal to one-half the height of the tooth. In some embodiments, the shield-free portion on the flanking surfaces extends from the root towards the crest for a distance that is less than one-half the height of the tooth.

In some embodiments disclosed herein, the tooth is formed of an inner core portion that is partially covered by a shield provided to resist erosion. In some of the embodiments, the shield is made of a material having at least 40% by volume of a hard metal powder, such as that selected from the group consisting of tungsten carbide, diamond, cubic boron nitride, and ceramics. The inner core portion is intended to be more impact resistant and, in certain embodiments, is made of powdered metal having not more than 30% by volume of the hard metal material. In some embodiments, the inner core portion forms at least two-thirds of the perimeter of the tooth.

The embodiments disclosed herein further include an inner row cutting tooth having a fluid baffle or fin extending from the upstream end of the tooth provided to divert drilling fluid quickly around the tooth and to lessen the erosion as may be caused by the impact with cuttings-laden drilling fluid.

Other embodiments disclosed herein include a rolling cone bit with first and second nozzles having non-uniform orientations so as to provide a flow of drilling fluid to predetermined locations or zones on the bit face where a substantial volume of drill cuttings are being generated.

Thus, embodiments described herein comprise a combination of features intended to address various shortcomings associated with certain prior devices. The various features and characteristics described above, as well as others described below, will be readily understood by those skilled in the art upon reading the following detailed description of preferred embodiments, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF PREFERRED EMBODIMENTS

Figure 1:
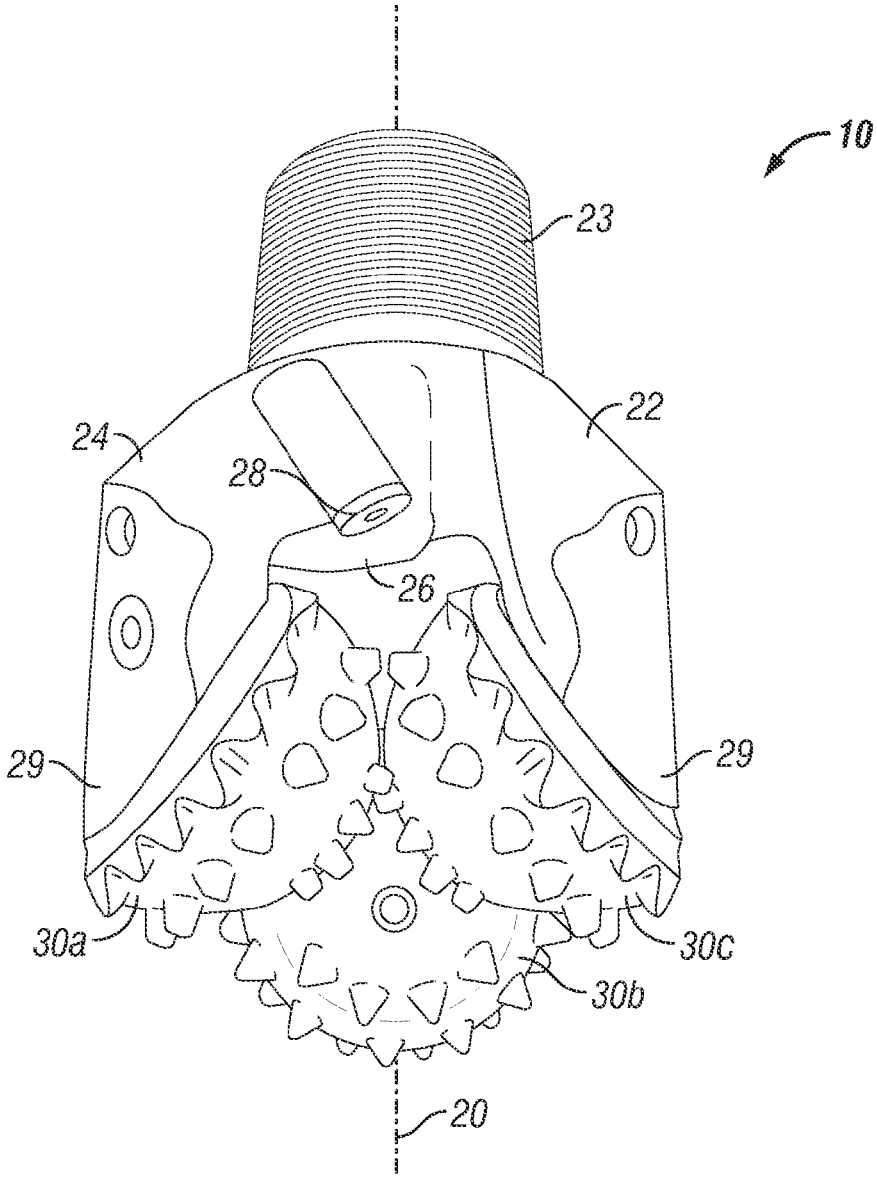
FIG. 1 is a perspective view of an embodiment of an earth-boring bit made in accordance with principles described herein.

The following description is exemplary of embodiments of the invention. These embodiments are not to be interpreted or otherwise used as limiting the scope of the disclosure, including the claims. One skilled in the art will understand that the following description has broad application, and the discussion of any embodiment is meant only to be exemplary of that embodiment, and is not intended to suggest in any way that the scope of the disclosure, including the claims, is limited to that embodiment.

The drawing figures are not necessarily to scale. Certain features and components disclosed herein may be shown exaggerated in scale or in somewhat schematic form, and some details of conventional elements may not be shown in interest of clarity and conciseness.

The terms "including" and "comprising" are used herein, including in the claims, in an open-ended fashion, and thus should be interpreted to mean "including, but not limited to . . . ." Also, the term "couple" or "couples" is intended to mean either an indirect or direct connection. Thus, if a first component couples to a second component, that connection may be through a direct engagement between the two components, or through an indirect connection via other intermediate components, devices and/or connections.

Referring first to FIG. 1, an earth-boring bit 10 includes a central axis 20 and a bit body 22 having a threaded pin section 23 at its upper end for securing the bit 10 to a drill string (not shown). Bit 10 has a predetermined gage diameter, defined by the outermost reaches of three rolling cone cutters 30*a*, 30*b*, 30*c* which are rotatably mounted on bit body 22. Exemplary bit 10 shown in FIG. 1 has a nominal diameter of 8.500 inches. Although bit 10 is shown to include three rolling cone cutters, in other embodiments, the bit may include one, two, or more cone cutters. Bit body 22 is composed of three sections or legs 24 that are welded together to form bit body 22 (only two legs 24 being shown in FIG. 1). The surface of bit body 22 extending between legs 24 and generally facing the borehole bottom is referred to herein as the underside 26 of bit body 22. As will be described in more detail below, bit 10 further includes a plurality of nozzles 28*a*-28*c* disposed in body 22 so as to direct drilling fluid to clean cutters 30*a*-30*c* (FIG. 2).

Figure 2:
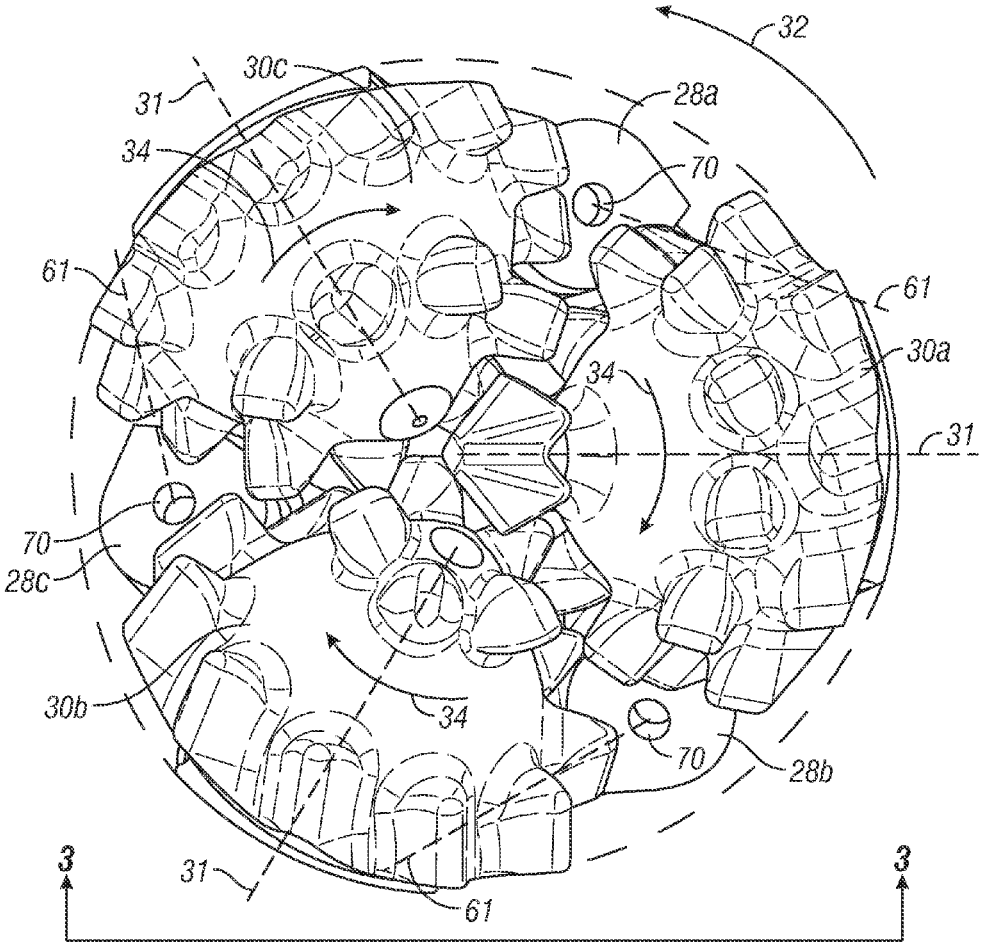
FIG. 2 is a view of the bottom of the bit of FIG. 1 as viewed from the borehole bottom.

Referring now to both FIGS. 1 and 2, each cone cutter 30*a*-30*c* is mounted on a pin (not shown) extending from bit body 22 and is supported via a bearing structure (not shown) that allows it to rotate about a cone axis of rotation 31 oriented generally downwardly and inwardly toward the center of the bit. Lubricant is supplied from a lubricant reservoir to the bearings by apparatus and passageways that are omitted from the figures for clarity. The lubricant is sealed in the bearing structure, and drilling fluid excluded therefrom, by means of an annular seal (not shown) which may take many forms. Bit legs 24 include a shirttail portion 29 that serves to protect the cone bearings and cone seals from damage arising from cuttings and debris entering between leg 24 and its respective cone cutter 30*a*-30*c*.

Figure 3:
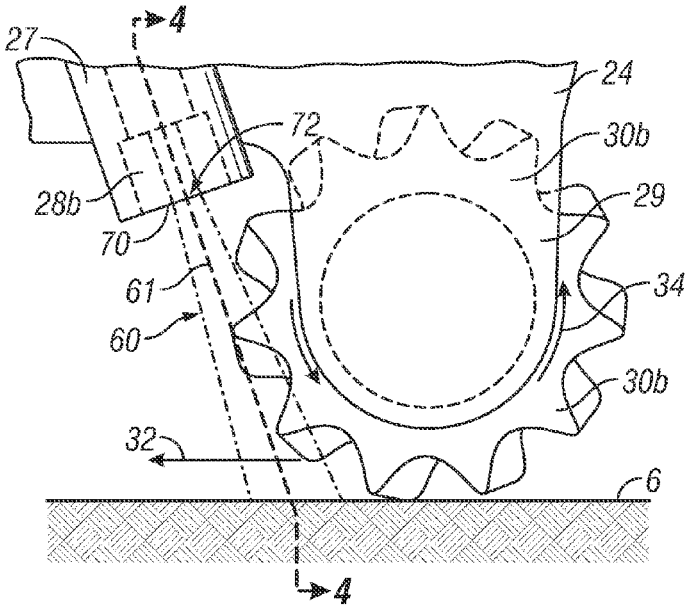
FIG. 3 is a side elevation view of a portion of the bit of FIG. 1 and showing one bit leg and one rolling cone cutter.
Figure 4:
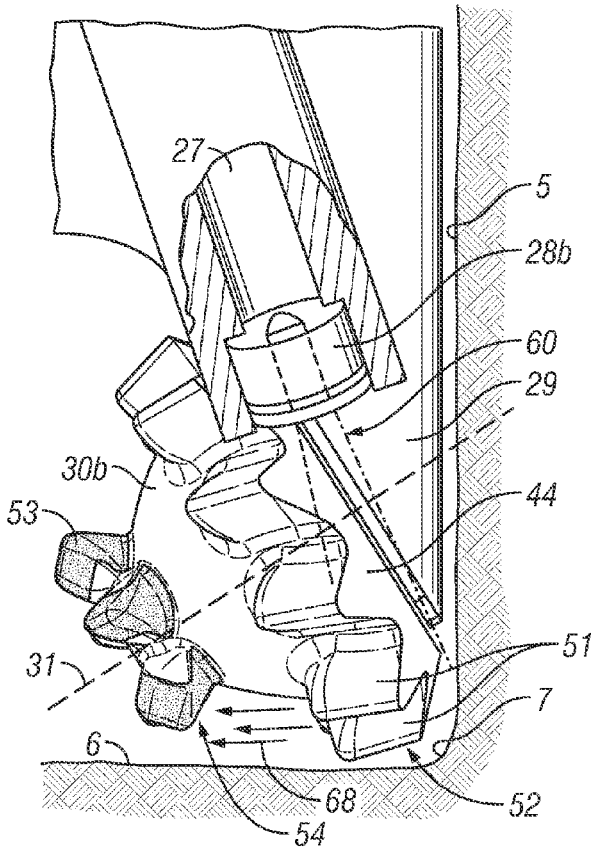
FIG. 4 is a partial section view taken along line 4-4 as shown in FIG. 3.

Referring to FIGS. 2-4, with weight applied to the bit, bit 10 is rotated in a direction 32 (counterclockwise as shown in FIG. 2). As cone cutters 30*a*-30*e* engage the borehole bottom, each rotates in a direction shown by reference to arrows 34. As shown in FIG. 4, the borehole created by bit 10 includes sidewall 5, bottom 6 and corner 7. Drilling fluid is pumped from the surface through the drill string to bit 10 where it first enters a central plenum (not shown) in bit body 22 from which it is distributed through internal fluid passageways 27 (FIGS. 3-4), and ultimately to nozzles 28.

Referring to FIGS. 2 and 6, each cone cutter 30*a*-30*c* includes a generally planar backface 40 and a nose 42 generally opposite backface 40. Adjacent to backface 40, cutters 30*a*-30*c* further include a generally frustoconical "gage" surface 44 that scrapes or reams the sidewall 5 of the borehole as the cone cutters rotate about the borehole bottom 6. A generally conical surface 46 extends between gage surface 44 and nose 42 and is adapted for supporting cutting elements that engage the borehole bottom 6.

Figure 6A:
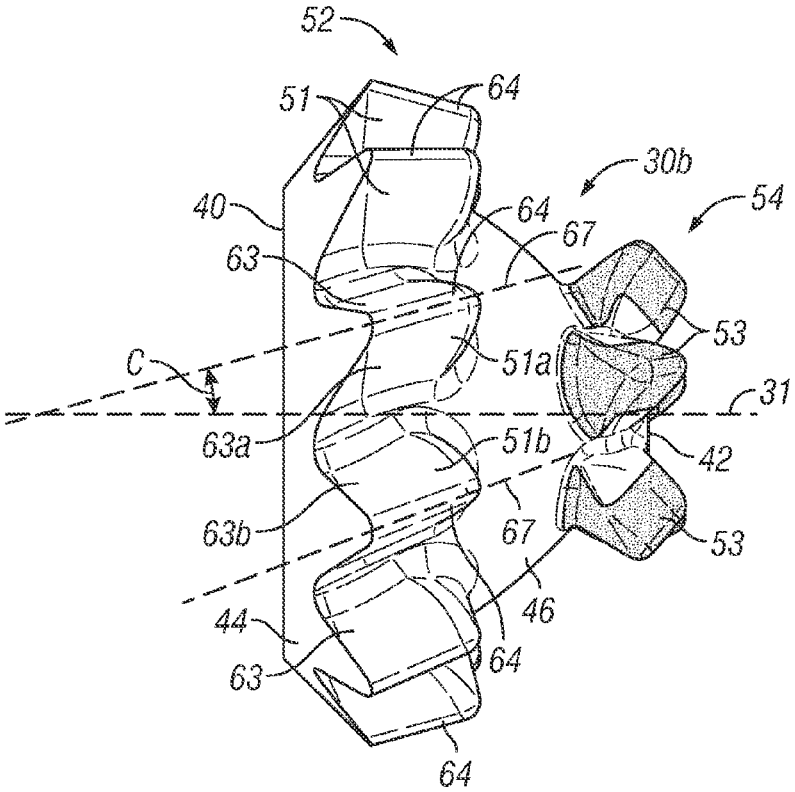
FIG. 6A is a side elevation view of one cone cutter of the bit of FIGS. 1-4.
Figure 6B:
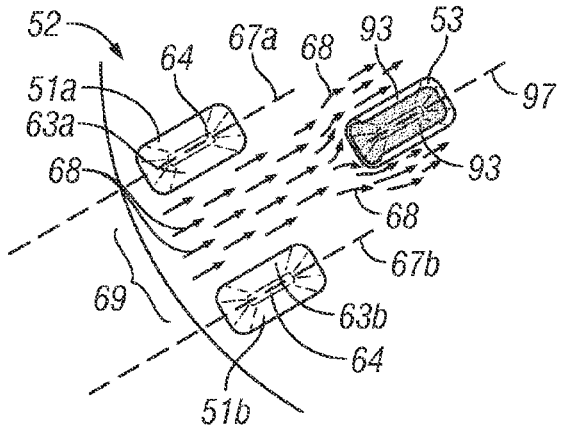
FIG. 6B is a schematic view showing fluid flow over a portion of the cone cutter shown in FIG. 6A.
Figure 7:
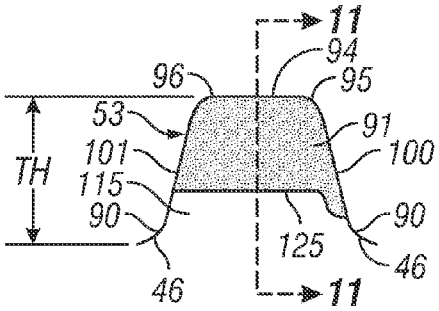
FIG. 7 is a side profile view of a cutting tooth of the cone cutter shown in FIG. 6A.
Figure 8:
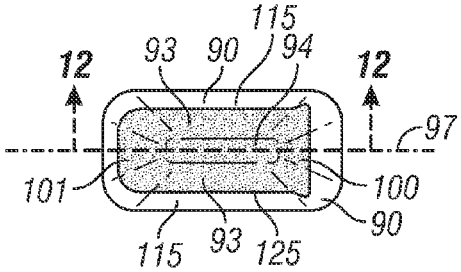
FIG. 8 is a top view of the cutting tooth shown in FIG. 7.
Figure 9:
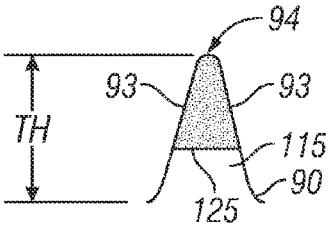
FIGS. 9 and 10 are, respectively, end views of the downstream and upstream end of the cutting tooth of FIGS. 7 and 8.
Figure 10:
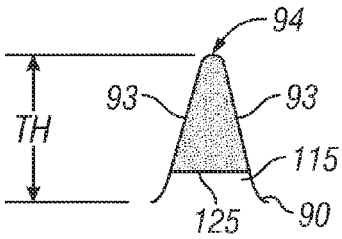

Each cone cutter 30*a*-30*c* includes a plurality of cutting teeth disposed about the cone and arranged in circumferential rows. For example, as best shown in FIG. 6A, rolling cone cutter 30*b* includes a plurality of gage cutting teeth 51 formed in a circumferential outer gage row 52. Cone cutter 30*b* further includes a circumferential inner row 54 of inner row cutting teeth 53. Inner row 54 is concentric to and spaced-apart from gage row 52. Gage row cutting teeth 51 cut the corner 7 of the borehole and maintain the borehole at full gage, while inner row cutting teeth 53 are employed to gouge and otherwise remove formation material from the borehole bottom 6. As best shown in FIG. 2, cone cutters 30*a* and 30*c* have gage and inner row cutting teeth that are similarly, although not identically, arranged as compared to cone 30*b*. The arrangement of inner rows of cutting teeth differs between the three cone cutters 30*a*-30*c* in order to maximize borehole bottom coverage, and also to provide clearance for the cutting teeth on the adjacent cone cutters. That is, inner row 54 in each cone is positioned a different distance from gage row 52 so that the cutting teeth 53 of inner row 54 of one cone will not interfere with the teeth of inner row 54 of adjacent rolling cone cutters 30*a*-30*c*.

In the embodiment described above, gage and inner row teeth 51, 53 are formed simultaneously with cones 30*a*-30*c* via known metallurgical processes. Suitable such processes, referred to variously as densification powder metallurgy, powder forging, and powder forge cutter processes, are disclosed in U.S. Pat. Nos. 4,368,788; 4,372,404; 4,398,952; 4,554,130; 4,562,892; 4,592,252; 4,597,456; 4,630,692; 4,853,178; 4,933,140; 4,949,598; 5,032,352; 5,653,299; 5,967,248; 6,045,750; 6,060,016; 6,135,218; 6,338,621; 6,347,676; all of which are incorporated herein by reference. These metallurgical processes enable cutting teeth to be formed into shapes and configurations that may be difficult to manufacture via other methods, and allow for the teeth to be integral with the cones.

As shown in FIGS. 1-4, bit 10 further includes a high velocity drilling fluid injection system that includes nozzles generally indicated at 28 for directing a drilling fluid stream 60. Each nozzle 28*a*-*c* is positioned between a pair of legs 24 and adjacent the outer circumference of bit body 22. Representative is nozzle 28*b* which, as best shown in FIGS. 3-4, is disposed at a location above the intersection of cone axis 31 with cone backface 40, and generally forward of cone 30*b* relative to its direction of travel 32 in the borehole. Each nozzle 28 is in fluid communication with passageway 27 which supplies drilling fluid for discharge through the orifice 70 of nozzle 28. Although the fluid stream 60 jetted from nozzle orifice 70 behaves in a complex manner, in order to simplify this discussion, the general direction and orientation of the discharged fluid is schematically represented by the stream 60 and by its nozzle flow centerline 61 which emanates from orifice center point 72.

It is to be further understood that nozzles of various sizes and types may be provided and may be positioned in various other locations on the bit body. For example, although not shown, a nozzle may also be provided in a generally central location on the underside 26 of the bit body 22 with an orifice directed toward the center of the borehole bottom 6. Likewise, nozzles can also be provided at radial positions generally inboard from the position of nozzles 28 and oriented so as to inject fluid on the cutting teeth when they have rotated to the position furthest from the borehole bottom. Whether such nozzles in addition to nozzles 28 are included in bit 10 will depend, in part, on the bit diameter.

Referring to FIGS. 3 and 4, given the position and orientation of nozzles 28*b*, after first striking on or adjacent to gage teeth 51 of gage row 52 on the leading side of cone cutter 30*b*, the drilling fluid stream 60 strikes bore hole bottom 6 on the leading side of and just ahead of cone cutter 30*b*. Reference arrow 32 indicates the direction of movement of leg 24 in the bore hole as bit 10 is rotated. Reference arrow 34 indicates the simultaneous rotation of cone cutter 30*b* with the movement of drill bit 10 in the bore hole. Thus, the high pressure drilling fluid stream 60 having nozzle flow centerline 61 is directed toward the leading surface of the cone cutter that trails slightly behind the nozzle 28 generating that flow. Such a placement of stream 60 cleans gage row cutting teeth 51 as the teeth rotate through stream 60 and just before they engage the borehole bottom 6. After fluid stream 60 passes gage teeth 51, it strikes the borehole bottom 6 generally at the borehole corner 7. The drilling fluid, along with the drilled cuttings, then sweeps across the borehole bottom toward bit axis 20 where the fluid stream contacts inner row cutter teeth 53, impacting them particularly severely on their radially-outermost surfaces and ends (also referred to herein as the "upstream" surfaces and ends). Conveyed by the drilling fluid, the drilled cuttings are then swept upward through the annulus and out of the bore hole.

Figure 5A:
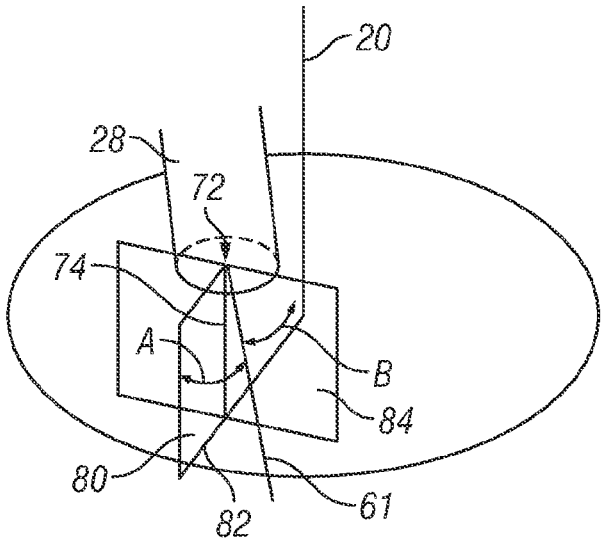
FIGS. 5A-5C are schematic representations showing the position and orientation of one nozzle of the bit shown in FIGS. 1-4.
Figure 5B:
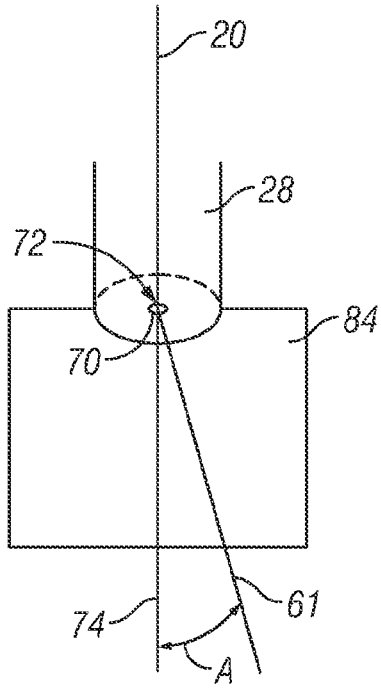
Figure 5C:
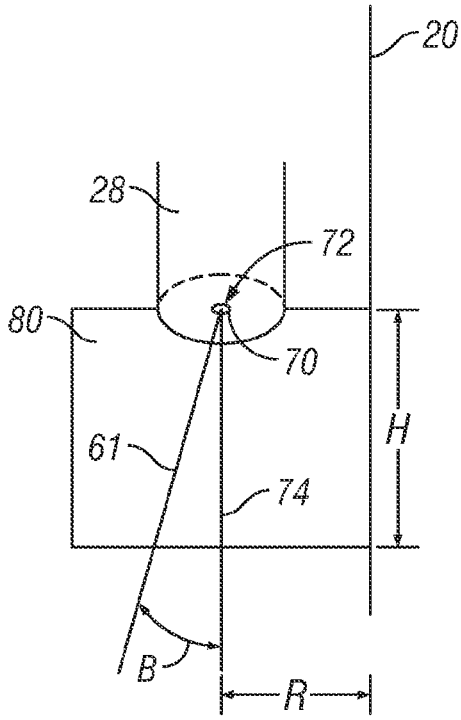

The position and orientation of nozzle 28 and fluid stream 60 may be further described with reference to FIGS. 5A-5C. As schematically shown, nozzle orifice 70 includes an orifice center point 72. A line 74 parallel to the bit axis 20 and passing through orifice center point 72 is referred to herein as the nozzle reference line 74, it being understood, however, that the nozzle flow centerline 61 that passes through orifice center point 72 is skewed or canted relative to nozzle reference line 74 in this embodiment.

A first reference plane 80 contains bit axis 20 and passes through orifice center point 72, extending radially away from bit axis along radial reference line 82. A second reference plane 84 passing through orifice center point 72 is perpendicular to first reference plane 80 and is also perpendicular to radial reference line 82. As best shown in FIG. 5C, nozzle 28 is positioned and oriented such that orifice center point 72 is positioned at a radial distance R from bit axis 20 and positioned a vertical distance or height H above the point of engagement between bit 10 and the borehole bottom 6. Nozzle 28 and orifice 70 are oriented such that nozzle flow centerline 61 extends at an angle A measured relative to first reference plane 80 and at an angle B measured relative to second reference plane 84, best shown in FIG. 5A. Thus, the canting or orientation of the nozzle 28 may be defined as being a combination of angles A and B. An angle A is positive when flow centerline 61 points generally toward the leading edge of immediately-trailing rolling cone cutter (as shown in FIGS. 3 and 5B). Conversely, angle A is negative when flow centerline 61 points generally toward the lagging edge of the immediately-preceding cone cutter. Angle B is a positive angle when, as shown in FIGS. 4 and 5C, it directs the fluid in the direction of hole wall 5, while angle B is negative when it directs the fluid toward the center of the bit and toward bit axis 20. When both the A and B angles are zero degrees, the drilling fluid is directed along nozzle flow centerline 61 that is parallel to the bit axis 20 and extends toward the hole bottom 6 along nozzle reference line 74.

Presently, it is conventional practice to orient the radially-outermost nozzles in a uniform manner so as to direct the flow of hydraulic fluid generally at the same portion of each cone. For example, and in the context of the angles described above, a conventional three-cone bit would include nozzles 28 between each pair of cone cutters and oriented so that all have the same A angles and all have the same B angles. However, due the different placement of inner row cutter elements, cone and journal offset, and certain other factors, it is understood that some areas of the bit generate more cuttings than others. Accordingly, nozzles 28*a-c* in bit 10 may be provided with unique orientations such that, after the drilling fluid is first directed to clean gage row cutting teeth 51, the high velocity drilling fluid is next directed to locations on inner rows 54 where maximum cutting generation is ongoing. Accordingly, as best understood with reference to FIG. 2 and FIGS. 5*a*-5*c*, bit 10 is provided with nozzles 28*a*, 28*b*, 28*c* which have unique and non-uniform orientations as defined in the table below.

TABLE I

NOZZLE ORIENTATION

| NOZZLE | ANGLE A | ANGLE B | RADIAL DISTANCE R | HEIGHT H |
|---|---|---|---|---|
| Nozzle 28a | 15° | 7° | 3.00 | 4.60 |
| Nozzle 28b | 19° | 7.5° | 3.10 | 4.60 |
| Nozzle 28c | 18° | 6.5° | 3.10 | 4.60 |

Given the position and orientation shown above in Table I, it is believed that, for the bit 10 shown in FIG. 2, the hydraulic fluid will be directed from the perimeter of the bit towards those locations where substantial cuttings are being generated, shown generally in FIG. 2 as zones $Z_1$, $Z_2$ and $Z_3$. In this embodiment, Zones 1-3 are contiguous. Zone 1 is an outer, annular region or band extending generally between the gage row teeth and a nearest adjacent inner row. Zone 2 is an annular region or band extending from the inner row that is the boundary of Zone 1 and closest to the gage row to the next closest inner row. Zone 3 is the remaining uncovered area of the bottom hole and is generally the central region of the borehole bottom.

These nozzle positions and orientations are provided in an effort to prevent or minimize bit balling by cleaning drilled cuttings first from the gage row cutting teeth 51, and substantially from inner row cutting teeth 53. The position and orientation noted in Table 1 above is exemplary for the bit 10 previously described. It is to be understood that, for other bits, including bits of different size and different cutting structures, the position and orientation defined by R, H and by angles A and B may be different than those disclosed in Table I. In a general sense, angle A will typically be in the range of 12°-25° and angle B will typically be in the range of 0-15 for the radially-outermost nozzles. Further, although, as described above, the position and orientation of the nozzles 28*a-c* may be different, other features of bit 10 described herein may be employed with bits having nozzles 28*a-c* are identically positioned and oriented.

With the desire to convey the drilling fluid inwards toward the zones $Z_1$-$Z_3$ where the greatest volume of chip and cutting formation is taking place, the gage row teeth 51 may be oriented in order to provide the least obstruction to the fluid flow and, further, to guide and channel the fluid directly to the locations where cleaning is most needed. Accordingly, referring to FIG. 6A, 6B, it can be seen that gage row teeth 51 are skewed relative to the cone axis 31. In the embodiment shown, gage cutting teeth 51 are generally chisel-shaped, having a pair of generally flat or planar flanking surfaces 63 terminating in an elongate crest 64, which extends along crest line 67. Teeth 51 are disposed on cone cutter 30*b* such that crest 64 and crest line 67 extend at angle C relative to cone axis 31. In other words, a projection of cone axis 31 and crest line 67 into the same plane results in these lines intersecting at angle C (FIG. 6A) which, in the embodiment described above, is approximately 20°. Optionally, the gage teeth may be positioned on cone cutter 30*b* to form an angle C relative to said cone axis of between 15° and 25°, and optionally, between 5° and 30°. In this arrangement where the crest line 67 does not lie in the same plane as the cone axis 31, the cutting teeth 51 and their crests are skewed relative to the cone axis. In this manner, and referring to FIG. 6B, the flanking surfaces 63 between adjacent teeth 51 act as a trough or channel to funnel and convey drilling fluid from the gage regions of the borehole toward the center of the borehole and bit axis 20. More specifically, flanking surfaces 63*a* and 63*b* of adjacent gage teeth 51*a* and 51*b* form fluid channel 69 and act to convey the drilling fluid (represented by arrows 68) generally in a direction parallel to crest lines 67.

Figure 16:
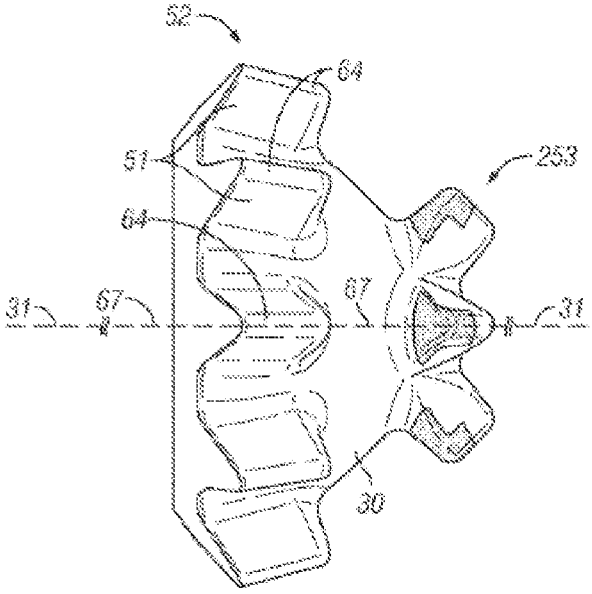
FIG. 16 is a side elevation view of another cone cutter made in accordance with principles described herein.

For other bit sizes and cutter arrangements, the crests 64 of gage teeth 51 may be oriented at other angles, depending upon the location where the fluid flow is most desired. For example, in other embodiments, the crest 64 and crest line 67 may be aligned with and lie within the same plane as cone axis 31 such that the angle C would be 0°, as shown in the example of FIG. 16. In this embodiment, cone 30 is substantially the same as cone 30*b* described above, except here each gage tooth 51 includes a crest 64 that extends along crest line 67, where crest line 67 is coplanar with cone axis 31.

As described above, it is desirable to direct fluid flow inwards to the inner row cutter elements in a manner such that the drilling fluid maintains a high velocity for optimum cleaning. As best described with reference to FIGS. 7-12, inner row teeth 53 are therefore provided with a shield or shielding cap so as to better resist erosion caused by abrasive drilling fluid impacting the teeth at high velocity. As shown, each inner row tooth 53 includes a root portion 90 that is adjacent to and extending from the generally conical surface 46 of the cone cutter 30*b*, and a cutting portion 91 extending away from the root portion 90. Tooth 53 further includes a pair of generally flat flanking surfaces 93 that extend away from the root 90 and that angle toward each other, the flanks 93 intersecting in an elongate crest 94. Crest 94 has a radially outer or upstream end 95 and a radially inner or downstream end 96 and extends along crest line 97. In this embodiment, and as explained in more detail below, tooth 53 is disposed on the cone cutter 30*b* such that the inner crest end 96 is closer to the bit axis 20 than the outer crest end 95. Tooth 53 further includes upstream end 100 and downstream end 101. End portions 100, 101 interconnect the two flanks 93, and extend away from the root potion 90 and terminate at the crest ends 95, 96, respectively. As thus described, tooth 53 forms a chisel shape having a generally linear crest 94 as illustrated by crest reference line 97.

Figure 11:
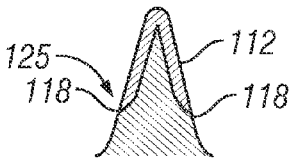
FIG. 11 is a cross-sectional view taken along the line 11-11 of the cutting tooth shown in FIG. 7.
Figure 12:
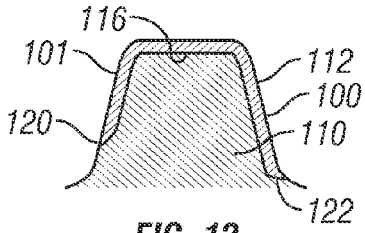
FIG. 12 is a cross-sectional view taken along line 12-12 of the cutting tooth shown in FIG. 8.

As best shown in FIGS. 11, 12, tooth 53 includes a core 110 that is partially covered by shield 112 to protect the tooth 53 from erosion as might otherwise be caused by abrasive drilling fluid impacting the tooth at a high velocity. Shield 112 forms a protective cap over certain surfaces of the cutting portion 91 of the tooth 53, while substantial portions of the root portion 90 of the tooth remains uncovered and thus unshielded. In the embodiment of FIGS. 7-12, shield 112 extends along the entire crest 94, and also extends downward along portions of the flanks 93 of the tooth. More specifically, the shield 112 of the embodiment of FIGS. 7-12 extends from the crest 94 toward the root 90 of the tooth on both flanks 93 a distance that is equal to approximately 65% of the tooth's height TH at those locations. Along the upstream or outer end 100 of the tooth (best shown in FIGS. 8, 10), the shield 112 extends still further toward cone surface 46, such that it extends approximately 80% of the tooth's height. In this configuration, the inner end portion 101, and each flank 93 includes a shield-free region or surface 115 adjacent to the root portion 90. Optionally, shield 112 extends at least 50% of the tooth's height at these locations. Along the inner or downstream end 101, shield 112 extends toward cone surface 42 to a distance approximately 65% of the tooth height TH (best shown in FIGS. 8 and 9). In the embodiment shown in FIGS. 7-12, the shield-free surface 115 of each flank 93 is approximately 35% of the tooth height TH and optionally is at least 30% of the tooth height TH. Preferably, the shield-free surface 115 of each flank 93 is less than 50% of the TH.

As best shown in FIGS. 11, 12, core 110 extends away from conical surfaces 46 of cone 30*b* and terminates in an internal crest 116 that extends parallel to the crest line 97. Core 110 includes lateral shoulders 118 (FIG. 11) and extends between each flank 93 and forms the shield-free portions 115. Likewise, core 110 forms the shield-free portion 115 of the tooth's inner end 101, and includes an inner shoulder 120 (FIG. 12) where it meets shield 112. Core 110 includes an outer shoulder 122 where it meets shield 112 at outer end 100. Outer shoulder 122 is closer to root portion 90 of the tooth 53 as compared to inner shoulder 120. Collectively, inner shoulder 120, outer shoulder 122 and lateral shoulders 118 form a landing for the terminus 125 of shield 112. Shield 112 covers the inner crest end of the core 110 and extends from the tooth's crest toward root 90 to the terminus 125 of shield 112. As measured normal to the flank 93, in this embodiment, shield 112 has a thickness of approximately 0.100 inch. Likewise, the shield has a thickness of approximately 0.250 inch as measured normal to the tooth's outer surface along the crest 94 and at each end 100, 101. Tooth 53 is formed such that the location where core 110 meets shield 112 is free of surface discontinuities such that the outer surface of tooth 53 is generally smooth and planar at terminus 125.

Core 110 is formed of a first material that is tougher and more fracture resistant than the material of the shield 112, while the shield 112 is formed from a material that is harder and more wear and abrasion-resistant than the material of the core 110. Typically, a composition with higher hardness indicates a higher resistance to erosion and wear, but also lower resistance to fracture (i.e., a lower toughness). Similarly, a material with a higher fracture toughness normally has a lower relative hardness and a lower resistance to wear and erosion. As such, the material of the shield 112 is more resistant to damage from erosion as may be caused by the high velocity drilling fluid impacting the tooth. At the same time, by leaving portions 115 of the flanks 93 shield-free and forming those unshielded portions 115 from the more fracture and impact resistance material from which core 110 is made, the tooth 53 is less susceptible to breakage of other damage caused by impact loading.

As previously mentioned, cones 30*a*-30*c* and inner row teeth 51, 53 may be formed by powder forging. Various hard materials are used in the powder forging processes, including materials where tungsten carbide, diamond, cubic boron nitride or ceramic materials are dispersed in a relatively softer metal matrix material, typically along with a binder metal such as cobalt. In manufacturing inner row cutting teeth 53, shield 112 is made of materials such that it will be harder than the material forming core 110. Exemplary compositions for shield 112 include a mixture of powdered tungsten carbide in amounts greater than 50% by volume of the powdered mixture. Optionally, the mixture may have greater than 60% volume of tungsten carbide and, further may have greater than 70% by volume of tungsten carbide. By way of contrast, it is preferred that the hardness of core 110 differ from that of shield 112. As an example, compositions for core 110 include mixtures where powdered tungsten carbide makes up less than 50% by volume of the composition, where the shield material is made of a composition of powdered tungsten carbide in amounts greater than 50% by volume. The percentage by volume of tungsten carbide in the powder composition of core 110 and shield 112 can be varied to achieve a desired wear-resistance and toughness.

By selecting different percentages of powdered hard metals (e.g., tungsten carbide, diamond, cubic boron nitride or ceramics) for use in forming shield 112 and core 110, after undergoing the powder forging process, the hardness of shield 112 will differ from the hardness of core 110. To describe physical characteristics (such as wear resistance or hardness) of different materials, the term "differs" as used herein means that the value or magnitude of the characteristic being compared varies by an amount that is greater than that resulting from accepted variances or tolerances normally associated with the processes used to formulate the raw materials and to form cutter elements from those materials. Thus, materials selected so that the forging process yields materials having the same nominal hardness or the same nominal wear resistance will not "differ," as that term has thus been defined, even though various samples of the material, if measured, would vary about the nominal value by a small amount.

Figure 13:
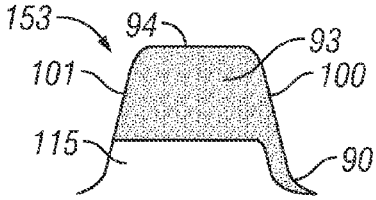
FIG. 13 is a side profile view of an alternative cutting tooth as may be employed in the cone cutter of FIG. 6A.
Figure 14:
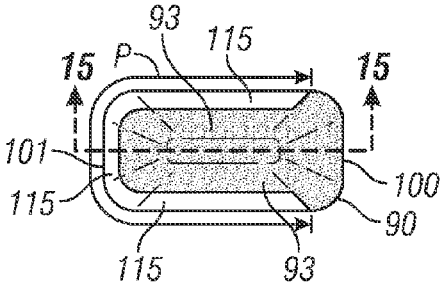
FIG. 14 is top view of the cutting tooth shown in FIG. 13.
Figure 15:
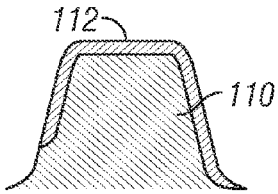
FIG. 15 is a cross-sectional view taken along line 15-15 of the cutting tooth shown in FIG. 14.

Shielding of inner row cutting teeth may take other forms. For example, referring to FIGS. 13-15, an inner row cutting tooth 153 is shown that is substantially similar to cutting tooth 53 shown in FIGS. 7-12; however, in the case of cutting tooth 153, shielding 112 extends along the outer end 100 so as to cover the entire root portion 90. Tooth 153 may be desirable in instances where drilling fluid stream 60 impacts more directly on the root or lower portion on the inner row tooth, or where it impacts directly on the cone surface adjacent to the tooth's root portion. In this example, extending shielding 112 on outer end 100 to cover the root portion 90 provides additional resistance to erosion. Even in this embodiment, however, the tooth 153 includes shield-free portions 115 along flanks 93 and along inner end 101. As with cutting tooth 53 of FIGS. 7-12, cutting tooth 153 includes an inner core 110 of a more impact-resistant and more robust material that is shielded by wear-resistant shielding 112 to provide erosion resistance where most appropriate. Here, as shown by reference line P in FIG. 14, approximately 75% of the tooth's perimeter along root 90 is free of shield 112. Optionally, at least 67% of the tooth's perimeter is kept free from the erosion resistant shield 112.

Figure 17:
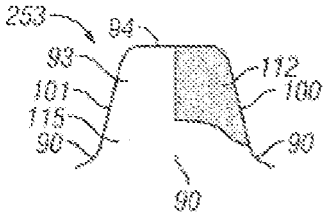
FIG. 17 is a side profile view of another cutting tooth made in accordance with principles described herein.
Figure 18:
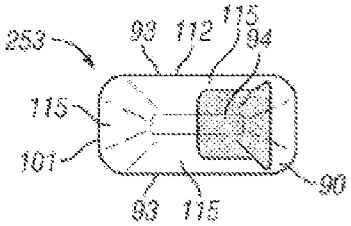
FIG. 18 is a top view of the cutting tooth shown in FIG. 17.

Another embodiment for an inner row cutting tooth is shown in FIGS. 16-18. As shown, inner row tooth 253 is substantially similar to inner tooth 53 previously described with reference to FIGS. 7-12 and includes shielding 112 that covers substantial portions of outer or upstream end 100, crest 94 and flanks 93. However, in this embodiment, shielding 112 does not extend along the entire crest 94, nor does it extend the entire width of flanks 93. In tooth 253, shield 112 covers less than one-half the length of crest 94, and inner end 101 is entirely free of shield 112. Cutting tooth 253 thus includes shield-free portions 115 on flanks 93 between root 90 and crest 94 adjacent upstream end 100, and further includes shield-free portions 115 along the radially-innermost portions of flanks 93 where they extend from root 90 to crest 94. Tooth 253 may be particularly desirable where it is required to make a design compromise between the desirability of wear-resistance and impact-resistance for crest 94 and inner end 101.

Figure 19:
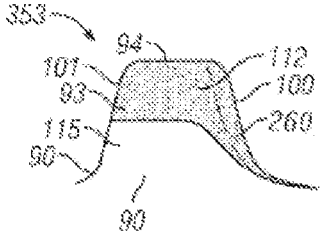
FIG. 19 is a side profile view of another cutting tooth made in accordance with principles described herein.
Figure 20:
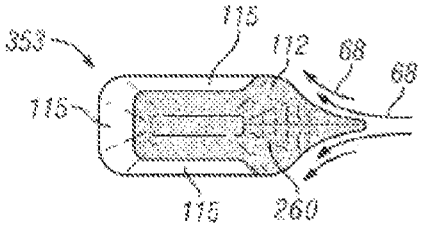
FIG. 20 is a top view of the cutting tooth shown in FIG. 19.

A further embodiment for an inner row cutting tooth is shown in FIGS. 19 and 20. As shown therein, inner row tooth 353 is substantially similar to inner tooth 53 previously described with reference to FIGS. 7-12. Tooth 353 includes shielding 112 that covers substantial portions of the upstream end 100, crest 94 and flanks 93. Shield-free portions 115 are included on each flank 93 and on downstream end 101. Tooth 353 further includes a fluid-dividing baffle 260 that extends from upstream end 100 from proximate the upstream end of the crest to the root portion 90. As best shown in top view of FIG. 20, baffle 260 is generally aligned with elongate crest 94. Baffle 260 is a fin or keel-like protuberance narrower in profile than the overall profile of crest ends 100 and 101 and is shaped to provide lessened resistance to the oncoming fluid flow as compared, for example, to the cutting tooth 53 previously described with its broader upstream end. Baffle 260 is coated with the erosion-resistant shield 112 to protect the tooth from erosion. However, as with cutting tooth 53, beneath shielding 112 is the inner core 110 of a more impact-resistant and robust material so as to better strengthen the tooth against damage from impact loads. As shown in FIG. 20, baffle 260 diverts drilling fluid flowing towards the tooth 353 around upstream end 100 as represented by reference arrow 68.

In addition to providing shield 112, further erosion-resistance for inner row teeth can be provided by aligning the teeth such that their crests 94 are generally aligned with channel 69 and with the direction of fluid flow impacting the upstream end of the tooth. Accordingly, and referring again to FIGS. 6A and 6B, gage row teeth 51 are positioned in the gage row 52 such that their crests are skewed relative to cone axis 31, the angle between crest line 67 and cone axis 31 being denoted as "C." Gage row teeth 51*a* and 51*b* guide and funnel the fluid flow in channel 69 in a direction denoted by reference arrows 68. In this embodiment, inner row cutter elements 53 are positioned on the cone such that crest 94 and crest line 97 are substantially aligned with the direction of fluid flow 68 and are substantially parallel to crest line 67*a,b* of gage teeth 51*a,b* when projected into a single plane. With inner row teeth 53 so aligned, the portion of cutting tooth 53 that is directly impacted by the fluid flow is generally limited to upstream end 100. Further, the rounded shape of upstream end 100 acts to divert the fluid flow 68 around tooth 53. By presenting a relatively small surface to the oncoming flow, the flow's velocity is diminished less than would be the case if the inner row tooth 53 was angled relative to the oncoming flow, and thereby presenting a broader surface for impact. As such, the arrangement thus described lessens the possibility that inner row teeth 53 become damaged by erosion. At the same time, the arrangement helps streamline the fluid flow across the flanking surfaces 93 of the cutter tooth 53 to maintain high velocity flow and aid in further cleaning of inner row teeth 53.

Providing a shield for inner row cutting teeth as described herein, and particularly on the upstream ends, offers the potential to improve bit durability and maintain ROP by resisting erosion to the cutting teeth. Forming the inner row teeth on the cone cutters so as to be generally aligned with the direction of drilling fluid flow may further aid in erosion resistance. Further, the positioning and orientation of nozzles 28 and orifices 70 offers the potential to enhance cleaning and to provide improved ROP by directing the high velocity drilling fluid first on the gage row teeth and then to regions on the bit face where cleaning is most needed. Likewise, orienting gage row, teeth so that flanking surfaces channel the flow from gage portions of the bit to the regions where the inner rows are most active in generating cuttings offers further potential for ROP improvement.

While preferred embodiments have been shown and described, modifications thereof can be made by one skilled in the art without departing from the scope or teachings herein. The embodiments described herein are exemplary only, and are not limiting. Many variations and modifications of the disclosed apparatus are possible and are within the scope of the invention. Although embodiments of the bits described herein are steel tooth bits, embodiments of the hydraulic layouts and designs for erosion-resistant teeth may also be employed with insert bits. Accordingly, the scope of protection is not limited to the embodiments described herein, but is only limited by the claims that follow, the scope of which shall include all equivalents of the subject matter of the claims.

What is claimed is:

1. A drill bit of gage diameter for drilling through earthen formations and forming a borehole having a sidewall, a borehole bottom and a borehole corner, the bit comprising:

a bit body;

a cone cutter coupled to said bit body and adapted for rotation about a cone axis of rotation;

a nozzle coupled to said bit body and adapted for discharging drilling fluid generally toward the borehole corner;

a circumferential gage row of gage cutting teeth on said cone cutter, said gage cutting teeth having a pair of flanking surfaces intersecting in a crest that extends along a gage tooth crest line, said gage tooth crest line forming an angle relative to said cone axis; and a circumferential inner row of inner cutting teeth spaced apart from said gage row, said inner cutting teeth comprising a root portion, an upstream end, a downstream end, a pair of flanking surfaces that intersect in a crest that extends along an inner tooth crest line, said inner cutting teeth further comprising an erosion shield on at least a portion of said upstream end and on at least a portion of said crest, and comprising a shield-free portion on said flanking surfaces that is disposed between said root and said crest;

wherein the upstream end comprises a fluid baffle extending from proximate the crest to the root portion and aligned with the crest in a top view, wherein the fluid baffle is a fin having a width less than a width of the crest.

2. The drill bit of claim 1 wherein said flanking surfaces on a pair of adjacent gage cutting teeth present a channel conveying drilling fluid along a predetermined fluid path, and wherein at least one of said inner cutting teeth is positioned within said fluid path.

3. The drill bit of claim 2 wherein said crest lines of said pair of adjacent gage teeth are parallel and form an angle relative to said cone axis of between 5° and 30°.

4. The drill bit of claim 1 wherein a pair of adjacent gage cutting teeth are disposed on said cone cutter and oriented such that said crest lines of said pair of gage cutting teeth are substantially parallel, and wherein an inner row cutting tooth is disposed on said cone cutter and oriented such that said inner tooth crest line lies between and is substantially parallel to said crest lines of said pair of adjacent gage cutting teeth.

5. The drill bit of claim 1 wherein said shield-free portion extends for a length of at least ⅔ of the perimeter of said inner cutting tooth.

6. The drill bit of claim 1 wherein said shield extends along said flanking surfaces from said crest toward said root position at least ½ the height of said inner cutting tooth.

7. The drill bit of claim 6 wherein said shield-free portion on said flanking surfaces extends at least ⅓ the height of said inner cutting tooth.

8. The drill bit of claim 6 wherein said shield ends at a shield terminus, and wherein said flanking surfaces are free of surface discontinuities at said terminus.

9. The drill bit of claim 1 further comprising at least a first and a second cone cutter coupled to said bit body and each adapted for rotation about a cone axis of rotation;

at least a first and a second nozzle coupled to said bit body and adapted for discharging drilling fluid generally towards said gage row cutting teeth of said first and second cone cutter, respectively, as the gage row cutting teeth rotate toward contact with the borehole bottom;

wherein the orientation of said first nozzle and said second nozzle differ.

10. A drill bit of gage diameter for drilling through earthen formations and forming a borehole having a sidewall, borehole corner and borehole bottom, the bit comprising:

a bit body having a bit axis of rotation;

a first cone cutter coupled to said bit body and adapted for rotation about a first cone axis of rotation;

a first circumferential gage row of gage cutting teeth on said first cone cutter, wherein each of the gage cutting teeth has a pair of flanking surfaces intersecting in a crest that extends along a gage tooth crest line skewed at an angle C relative to the cone axis;

a first nozzle coupled to said bit body having a first nozzle orifice oriented to discharge drilling fluid along a flow path having a nozzle flow centerline;

wherein the nozzle flow center line of the first nozzle orifice is oriented at an angle $A_1$ measured relative to a first reference plane defined by the bit axis and a center point of the first nozzle orifice;

wherein the nozzle flow centerline of the first nozzle orifice is oriented at an angle $B_1$ between 0° and 15° measured relative to a second reference plane that contains the center point of the first nozzle orifice and that is perpendicular to the first reference plane;

wherein the first nozzle orifice oriented at the angle $A_1$ and the angle $B_1$ is configured to direct drilling fluid toward the gage row of gage cutting teeth on a leading side of the first cone cutter and the crests of the gage cutting teeth oriented at the angle C are configured to direct drilling fluid toward the bit axis;

a second cone cutter coupled to said bit body and adapted for rotation about a second cone axis of rotation;

a second circumferential gage row of gage cutting teeth on said second cone cutter; and a second nozzle coupled to said bit body having a second nozzle orifice oriented to discharge drilling fluid along a flow path having a nozzle flow centerline extending generally toward the borehole corner and passing through said gage row of gage cutting teeth at a location on the leading side of said second cone cutter.

11. The drill bit of claim 10 wherein said nozzle flow centerline of said second nozzle orifice extends at an angle $A_2$ measured relative to a third reference plane that contains said bit axis and the center point of said second nozzle orifice; and wherein $A_1$ is not equal to $A_2$.

12. The drill bit of claim 11 wherein said nozzle flow centerline of said second nozzle orifice extends at an angle $B_2$ measured relative to a fourth reference plane that contains the center point of said second nozzle orifice and that is perpendicular to said second reference plane; and wherein $B_1$ and not equal to $B_2$.

13. The drill bit of claim 11 wherein $A_1$ and $A_2$ are within the range of 12° to 25°.

14. The drill bit of claim 12 wherein $B_1$ and $B_2$ are within the range of 0° to 15°.

15. The drill bit of claim 11 wherein $A_1$ is at least 2° greater than $A_2$.

16. The drill bit of claim 10 wherein at least one of said first and second cone cutters further comprises:

a circumferential gage row of gage cutting teeth on said cone cutter, said gage cutting teeth having a pair of flanking surfaces intersecting in a crest that extends along a gage tooth crest line, said gage tooth crest line forming an angle relative to said cone axis;

a circumferential inner row of inner cutting teeth spaced apart from said gage row, said inner cutting teeth comprising a root portion, an upstream end, a downstream end, a pair of flanking surfaces that intersect in a crest that extends along an inner tooth crest line, said inner cutting teeth further comprising an erosion shield on at least a portion of said upstream end and on at least a portion of said crest, and comprising a shield-free portion on said flanking surfaces that is disposed between said root and said crest.

17. A drill bit of gage diameter for drilling a borehole through earthen formations, comprising:

a rolling cutter having a generally conical surface mounted on a bit body and adapted for rotation about a cone axis;

a cutting tooth integrally formed with said rolling cutter and comprising:

a root portion adjacent said generally conical surface;

a pair of flanking surfaces extending from said root portion and angling towards one another and intersecting to form an elongate crest;

ends portions, including an upstream end and a downstream end, at opposite ends of said crest; and a shielding cap disposed along at least a portion of said crest and extending from said crest toward said root portion on at least said upstream end;

wherein said flanking surfaces and said downstream end include shield free portions adjacent said root portion;

wherein the upstream end comprises a fluid baffle extending from proximate the crest to the root portion and aligned with the crest in a top view, wherein the fluid baffle is a fin having a width less than a width of the crest.

18. The drill bit of claim 17 wherein said shielding cap on said flanking surface extends from said crest toward said root portion for a distance greater than or equal to ½ the height of said tooth.

19. The drill bit of claim 17 wherein said shield free portion on said flanking surface extends from said root toward said crest for a distance less than ½ the height of said tooth.

20. The drill bit of claim 17 wherein said shield free portion on said flanking surface extends from said root toward said crest for a distance of less than ½ of the height of said tooth, and wherein said root portion is made from a powdered metal composition having less than 50% by volume of a powdered material selected from the group consisting of tungsten carbide, diamond, cubic boron nitride, and ceramics, and wherein said shielding cap is made from a powdered metal composition having more than 50% by volume of a powdered material selected from the group consisting of tungsten carbide, diamond, cubic boron nitride, and ceramics.

21. The drill bit of claim 17 wherein said baffle is covered by said shielding cap.

22. A drill bit of gage diameter for drilling a borehole in the earth, comprising:

a bit body;

a cone cutter having a generally conical surface coupled to said bit body and adapted for rotation about a cone axis; and a cutting tooth extending from said generally conical surface comprising:

an upstream end and a downstream end;

an inner core portion comprising a first material having not more than 30% by volume of a powdered material selected from the group consisting of tungsten carbide, diamond, cubic boron nitride, and ceramics;

a shield partially covering the inner core portion and comprising a second material having at least 40% by volume of a powdered material selected from the group consisting of tungsten carbide, diamond, cubic boron nitride, and ceramics;

a pair of flanking outer surfaces intersecting to form an elongate crest that is spaced-apart from the generally conical surface and that extends generally along a crest line;

the shield forming the crest and forming a first portion of each of the flanking surfaces that extends from the crest line to a shield terminus;

the inner core portion forming a second portion of each of the flanking surfaces that extends from the generally conical surface to the shield terminus;

wherein the second portion of each flanking surface extends a distance of at least 30% of the tooth height;

wherein the upstream end comprises a fluid baffle extending from proximate the crest to the root portion and aligned with the crest in a top view, wherein the fluid baffle is fin having; a width less than a width of the crest.

23. The drill bit of claim 22 wherein said shield extends along said upstream end for a distance of at least ¾ of the tooth height, and wherein said downstream end includes a shield free portion that extends a distance of at least 30% the tooth height.

24. The drill bit of claim 22 wherein said shield covers said upstream end from the crest to the generally conical surface of the cone cutter.

25. The drill bit of claim 22 wherein said inner core portion forms at least ⅔ of the perimeter of the tooth.

26. The drill bit of claim 22 wherein said flanking surfaces are free of surface discontinuities at said terminus.

* * * * *